United States Patent [19]

Otuki, Kazumaru

[11] 3,991,499

[45] Nov. 16, 1976

[54] VARIABLE CALENDAR

[76] Inventor: Kazumaru, Otuki, 6-6 Honjo, 2-chome, Matumotoshi, Naganoken, Japan

[22] Filed: May 21, 1975

[21] Appl. No.: 579,579

[30] Foreign Application Priority Data

May 21, 1974 Japan .....49-058539

[52] U.S. Cl. ..... 40/109; 40/17

[51] Int. Cl.² ..... G09D 3/04

[58] Field of Search ..... 40/109, 17, 18, 107, 40/64 R

[56] References Cited

UNITED STATES PATENTS

| | | | |
|---|---|---|---|
| 225,045 | 3/1880 | Bishop | 40/17 X |
| 1,186,835 | 6/1916 | Rollins | 40/109 |
| 1,511,568 | 10/1924 | Lape | 40/109 |
| 2,604,712 | 7/1952 | Le Blanc | 40/17 X |

FOREIGN PATENTS OR APPLICATIONS

| | | | |
|---|---|---|---|
| 2,061,399 | 6/1971 | Germany | 40/109 |
| 273,980 | 6/1951 | Switzerland | 40/109 |

*Primary Examiner*—John F. Pitrelli

*Attorney, Agent, or Firm*—Stewart and Kolasch, Ltd.

[57] ABSTRACT

A variable calendar is provided in which the days of the week for several successive weeks are displayed in registry in first and second fixed scales which cooperate, respectively, with first and second sliding scales cumulatively displaying the calendar dates of the days of an entire month and positioned adjacent and parallel to the fixed scales with the spacing intervals of the various scale indicia being identical. The sliding scales are preferably arranged such that the first represents the calendar dates "1" to "15" and the second represents the calendar dates "16" to "31". One sliding scale is offset with respect to the other, i.e., the "16" is in registry with the "2" such that the dates will correlate properly with the days of the week when the sliding scales are positioned relative to the fixed scales.

4 Claims, 3 Drawing Figures

VARIABLE CALENDAR

FIELD OF THE INVENTION

This invention relates to variable calendars and more particularly to a calendar universally adopted to correlate the day of the week with the date of the month in any given year.

BACKGROUND OF THE INVENTION

The common calendar known in the art is an inflexible annual chart in which the dates of a given month are correlated with the seven days of each week in a separate and fixed display for each month of the year. Universal calendars have been achieved using complex tables or relatively large, complex and cumbersome dialing devices, all of which are relatively difficult to use. Thus, there is an established need in the art for a simple and compact calendar device which is not limited to any given year and which will readily provide the user with future and past dates of given months correlated to the days of the week.

It is, therefore, an object of the present invention to provide a new and novel variable calendar device which is compact in size, of optimum simplicity in structure and operation and which is universally adaptable to correlate the calendar dates of a given month with the days of the week in any given calendar year either past, present or future.

These and other objects of the invention will become more fully apparent with reference to the following specification and drawing which relate to a preferred embodiment of the present invention.

SUMMARY OF THE INVENTION

The present invention comprises first and second fixed parallel scales representing successive days of the week for several successive weeks (at least three successive weeks) in each scale with the days of the week in one scale being in registry with like days of the week in the other scale.

First and second sliding scales are provided adjacent the first and second fixed scales, respectively. The first sliding scale has the calendar dates 1 through 15 at spaced intervals equal to the spaced intervals between the days of the week on the first fixed scale. The second sliding scale has the calendar dates 16 to 31 at like spaced intervals with the calendar date 16 in registry with the calendar date 2 on the first sliding scale.

By positioning a known calendar date with a known corresponding day of the week in any given month by relative sliding movement of the sliding scales to the fixed scales, the registered position of the remaining calendar dates will be in accordance with the corresponding day of the week for that given month.

Furthermore, by successive positioning of the first day of each next succeeding month or the last day of each next preceding month, the calendar dates and correlated days of the week for future and past months may be rapidly determined. In other words, past and future dates are determined by counting back or counting forward with successive positions of the sliding scales relative to the fixed scales for each month to be determined.

DETAILED DESCRIPTION OF THE INVENTION

Figure 1:
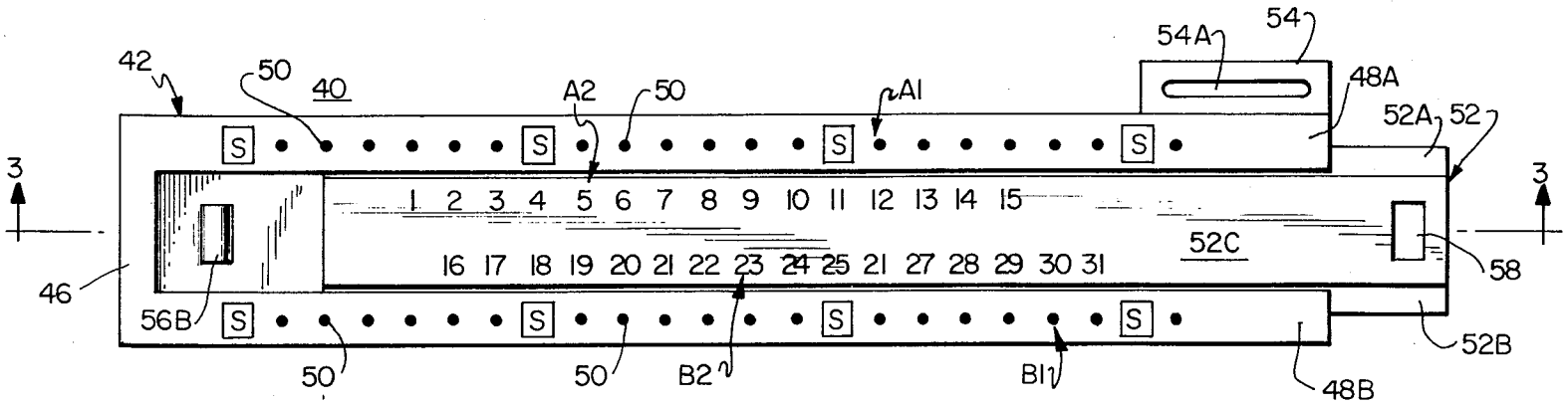
FIG. 1 is a top plan view of the variable calendar of the present invention.
Figure 2:
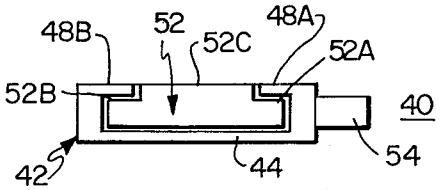
FIG. 2 is a right end view of the variable calendar illustrated in FIG. 1.
Figure 3:
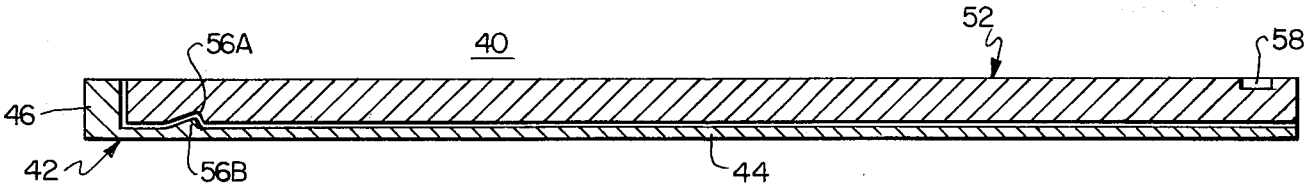
FIG. 3 is a cross-section taken along line 3—3 of FIG. 1.

Referring in detail to the drawing and with joint reference to FIGS. 1, 2 and 3, the variable calendar 40 of the present invention is shown as comprising a rectangular case member 42 having a solid bottom 44 and an upstanding left end wall 46, leaving the right hand end of the said case 42 open.

The upstanding left end wall 46 serves as a bridge between first and second inturned flange members 48A, 48B (best shown in FIG. 2) which carry, respectively, first and second fixed scales A1 and B1.

The said fixed scales A1 and B1 are in registry with one another and include, for example the letters "S" separated by six dots or reference marks 50 representative of the days of the week. The letter S for example designates a Sunday and the consecutive dots 50 running to the next adjacent letter S designate, respectively, Monday, Tuesday, Wednesday, Thursday, Friday and Saturday. While Sunday is used as the reference day, such is not necessary so long as the symmetry of the fixed scales A1 and B1 remains as indicated in FIG. 1 and each reference day is the same day of the week.

The inturned flanges 48A, 48B provide a T-shaped hollow cross-section to the interior of the case 42 to telescopically receive a similarly shaped generally rectangular slide member 52 having integral shoulders 52A and 52B respectively underlying the inturned flanges 48A and 48B.

The case 42 is open sided between the flanges 48A and 48B and the top surface 52C of the slide 52 projects upwardly to a substantially coplanar position with the fixed scales A1 and B1.

On the top surface 52C of the slide 52 are first and second sliding scales A2 and B2 positioned, respectively, adjacent the fixed scales A1 and B1.

The first sliding scale A2 comprises the calendar date numbers 1 through 15 with the same spacing intervals between numbers as between the days of the week 50 on the first fixed scale A1 adjacent to and extending parallel to the said fixed scale A1. Similarly, the second sliding scale B2 comprises the calendar date numbers 16 through 31 with the same spacing intervals between numbers as between the days of the week 50 on the first and second fixed scales A1 and B1 and located adjacent to and extending parallel to the said second fixed scale B1.

The proper registry between the first and second sliding scales A2 and B2 is achieved by offsetting the second scale B2 to the right of the first scale A2 such that the date numeral 16 is in registry with the date numeral 2.

While other scale capacities such as 1 through 16 and 17 through 31 also be used by adjusting the offset accordingly, the preferred embodiment is as described above.

Further, depending upon the ultimate size of the variable calendar 40, the letters S and dots 50 on the fixed scales A1 and B1 may comprise abbreviations of the days of the week or full spelling thereof as desired.

The embodiment illustrated can be of a size suitable for attachment to a key chain or the like and is provided with a mounting bracket or flange 54, perforated or slotted at 54A adjacent the open end of the case 42 for attachment to such a device.

In the portable embodiment shown, the slide member 52 is provided with a detent slot 56A on its lower side which cooperates with an upstanding detent 56B on the interior bottom wall of the case 42 to prevent the slide 52 from falling out of the open end of the case 42. Both detent means 56A and 56B are adjacent the closed end 46 of the case 42 such that the slide 52 will be latched in its fully inserted position in the case 42 but will not be impeded during normal operation of the calendar because the said detent 56B is sufficiently offset to the left of the fixed scales A1 and B1.

A notch 58 is provided adjacent the outboard end of the slide 52 to provide a finger grip to overcome the action of the detents 56A, 56B when it is desired to operate the variable calendar 40.

OPERATION OF THE INVENTION

In the position shown in FIG. 1, the slide 52 is positioned with the first of the month, for example, the month of May 1975, occurring on a Thursday. Therefore, the thirty-first day of May 1975, would fall on a Saturday.

To determine when the fifteenth of June 1975 occurs, for example, the slide 52 is moved such that the date numeral 1 is positioned on the day next following the thirty-first, a Sunday, and the date numeral 15 is found to be adjacent to and fall on a Sunday.

Now, if a date in July is desired instead of a date in June, the date number 30, the last day of June is noted as falling on a Monday, thereby designating a Tuesday as July 1, 1975.

With the date number 1 next set on a Tuesday, then any date in July is identified by the day of the week on the case 42 in registry with the respective date numbers on the slide 52.

All of the months of a year or succeeding or past years can be displayed by successive positionings of the slide 52 in the case 42 in the normal sequence of months, i.e., forward in its sequence for future months and in reverse sequence for past months.

It is claimed:

1. A variable calendar device comprising:

a housing member having first and second fixed parallel scales thereon, each said scale having day indicia representing the days of several consecutive weeks at regularly spaced intervals, like days of the week of one scale being in registry with those in the other scale; and a slide member mounted in said housing between said first and second fixed scales and having first and second movable scales thereon adjacent and parallel, respectively, to said first and second fixed scale, said first and second movable scales being fixed with respect to each other and movable with respect to said first and second fixed scales, and having date indicia thereon representative of calendar dates of a calendar month;

said date indicia being of like spacing as said day indicia;

said date indicia in said first movable scale representing approximately one-half of a maximum length calendar month and said date indicia in said second movable scale representing the remaining days in that month;

said date indicia in said first and second scales being offset such that said date indicia is properly correlated with said day indicia;

said housing member and said slide member are basically rectangular and said slide member is telescopically movable in said housing member;

said housing member includes first and second parallel inturned flanges substantially coterminate with the length dimension of said housing member and bearing, respectively, said first and second fixed scales in respective straight line configurations; and wherein said slide member includes laterally extending shoulders, slidable beneath said inturned flanges to slidably retain said slide member within said housing member, said slide member having a surface of substantially the same length as said flanges and bearing said first and second movable scales in coplanar relationship with said fixed scales.

2. The invention defined in claim 1, wherein said slide means and said housing means further include cooperating detent means retaining said slide member immobile in said housing member when said slide member is fully inserted in said housing member.

3. The invention defined in claim 2, wherein said housing member further includes a mounting bracket adjacent one end thereof.

4. The invention defined in claim 2, wherein said slide member further includes gripping means for overcoming the detent action of said detent means.

* * * * *